US008679722B2

(12) United States Patent
Aoyagi et al.

(10) Patent No.: US 8,679,722 B2
(45) Date of Patent: Mar. 25, 2014

(54) METHOD FOR PRODUCING PHOTORECEPTOR AND PROCESS CARTRIDGE AND IMAGE-FORMING APPARATUS INCLUDING PHOTORECEPTOR

(75) Inventors: Keiichi Aoyagi, Kanagawa (JP); Masami Tanase, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 219 days.

(21) Appl. No.: 13/194,532

(22) Filed: Jul. 29, 2011

(65) Prior Publication Data

US 2012/0196213 A1 Aug. 2, 2012

(30) Foreign Application Priority Data

Jan. 31, 2011 (JP) ..... 2011-018887

(51) Int. Cl.
*G03G 5/00* (2006.01)

(52) U.S. Cl.
USPC ..... 430/127; 399/159

(58) Field of Classification Search
USPC ..... 430/127; 399/159
See application file for complete search history.

(56) References Cited

U.S. PATENT DOCUMENTS

| | | | | |
|---|---|---|---|---|
| 4,764,448 | A * | 8/1988 | Yoshitomi et al. | 430/119.81 |
| 6,763,208 | B2 | 7/2004 | Nagatsuna et al. | |
| 7,186,489 | B2 | 3/2007 | Uematsu et al. | |
| 2002/0136565 | A1 | 9/2002 | Nagatsuna et al. | |
| 2006/0008717 | A1 | 1/2006 | Uematsu et al. | |
| 2008/0187858 | A1 * | 8/2008 | Taguchi | 430/127 |
| 2011/0104603 | A1 * | 5/2011 | Yu et al. | 430/96 |

FOREIGN PATENT DOCUMENTS

| | | | |
|---|---|---|---|
| JP | 5-265243 | A | 10/1993 |
| JP | 2010-91934 | A | 4/2010 |

OTHER PUBLICATIONS

Communication from Australian Patent Office in corresponding Australian Patent Application No. 2011218600 dated Jul. 16, 2012.
Australian Office Action issued on Jul. 18, 2013 in Australian Application No. 2011218600.

* cited by examiner

*Primary Examiner* — Mark A Chapman
(74) *Attorney, Agent, or Firm* — Sughrue Mion, PLLC

(57) ABSTRACT

A method for producing a photoreceptor includes forming at least a photosensitive layer as a coating layer on a surface of a substantially cylindrical photoreceptor; and polishing a surface of the coating layer formed on the photoreceptor in the layer formation by rotating the photoreceptor and moving a polishing member in a direction crossing a circumferential direction of the photoreceptor in contact with the surface of the coating layer on the photoreceptor.

5 Claims, 14 Drawing Sheets

FIG. 11

| | | UNPOLISHED | EXAMPLE 1 | EXAMPLE 2 | EXAMPLE 3 | MANUALLY POLISHED |
|---|---|---|---|---|---|---|
| AXIAL DIRECTION | | PROFILE CURVE (μm) | PROFILE CURVE (μm) | PROFILE CURVE (μm) | PROFILE CURVE (μm) | PROFILE CURVE (μm) |
| | Ra | 0.0054 | 0.0106 | 0.0124 | 0.0077 | 0.0053 |
| | Rmax | 0.067 | 0.108 | 0.158 | 0.110 | 0.058 |
| CIRCUMFERENTIAL DIRECTION | | PROFILE CURVE (μm) | PROFILE CURVE (μm) | PROFILE CURVE (μm) | PROFILE CURVE (μm) | PROFILE CURVE (μm) |
| | Ra | 0.0053 | 0.0054 | 0.0065 | 0.0056 | 0.0130 |
| | Rnax | 0.059 | 0.051 | 0.103 | 0.060 | 0.240 |

FIG. 14

| | | UNPOLISHED | EXAMPLE 1 | EXAMPLE 2 | EXAMPLE 3 | MANUALLY POLISHED |
|---|---|---|---|---|---|---|
| AXIAL DIRECTION | | PROFILE CURVE (μm) | PROFILE CURVE (μm) | PROFILE CURVE (μm) | PROFILE CURVE (μm) | PROFILE CURVE (μm) |
| | Ra | 0.0082 | 0.0088 | 0.0116 | 0.0080 | 0.0099 |
| | Rmax | 0.145 | 0.096 | 0.099 | 0.075 | 0.090 |
| CIRCUMFERENTIAL DIRECTION | | PROFILE CURVE (μm) | PROFILE CURVE (μm) | PROFILE CURVE (μm) | PROFILE CURVE (μm) | PROFILE CURVE (μm) |
| | Ra | 0.0052 | 0.0054 | 0.0053 | 0.0061 | 0.0120 |
| | Rnax | 0.064 | 0.052 | 0.053 | 0.060 | 0.101 |

METHOD FOR PRODUCING PHOTORECEPTOR AND PROCESS CARTRIDGE AND IMAGE-FORMING APPARATUS INCLUDING PHOTORECEPTOR

CROSS-REFERENCE TO RELATED APPLICATIONS

This application is based on and claims priority under 35 USC 119 from Japanese Patent Application No. 2011-018887 filed Jan. 31, 2011.

BACKGROUND (i) Technical Field

The present invention relates to methods for producing photoreceptors and process cartridges and image-forming apparatuses including photoreceptors.

(ii) Related Art

In the related art, a photoreceptor having a surface deliberately roughened during production is used because an as-produced photoreceptor having a nearly mirror surface might cause a problem, for example, during a cleaning step due to an excessive coefficient of friction between the surface of the photoreceptor and a cleaning blade.

SUMMARY

According to an aspect of the invention, there is provided a method for producing a photoreceptor. This method includes forming at least a photosensitive layer as a coating layer on a surface of a substantially cylindrical photoreceptor; and polishing a surface of the coating layer formed on the photoreceptor in the layer formation by rotating the photoreceptor and moving a polishing member in a direction crossing a circumferential direction of the photoreceptor in contact with the surface of the coating layer on the photoreceptor.

BRIEF DESCRIPTION OF THE DRAWINGS

Exemplary embodiments of the present invention will be described in detail based on the following figures, wherein:

FIG. 11 is a set of graphs showing the surface roughness of photoreceptors produced by the method for producing a photoreceptor according to the first exemplary embodiment of the invention;

FIG. 14 is a set of graphs showing the surface roughness of the photoreceptors produced by the method for producing a photoreceptor according to the first exemplary embodiment of the invention;

DETAILED DESCRIPTION

Exemplary embodiments of the present invention will now be described with reference to the drawings.

First Exemplary Embodiment

Figure 2:
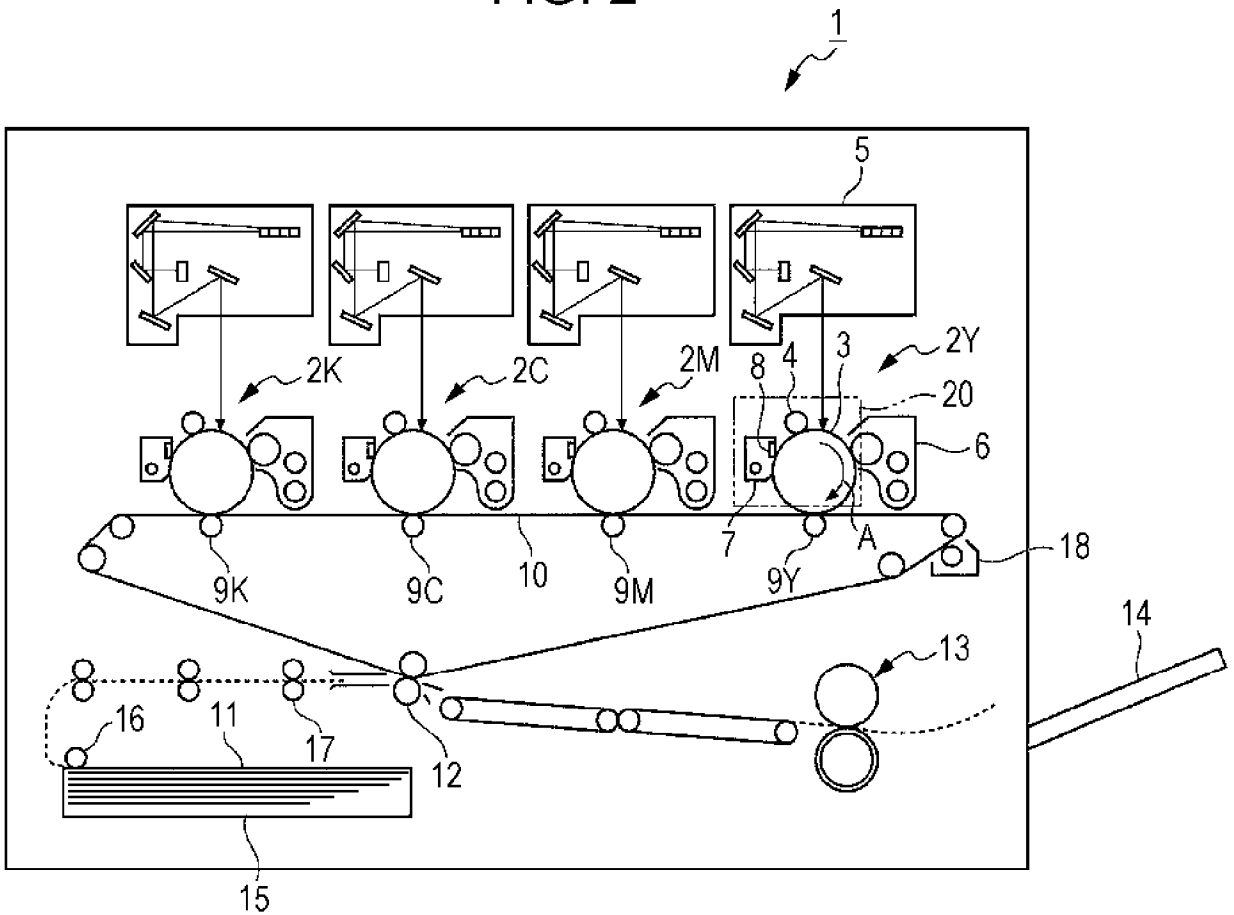
FIG. 2 is a schematic diagram showing an image-forming apparatus including photoreceptors produced by the method for producing a photoreceptor according to the first exemplary embodiment of the invention.

FIG. 2 shows an image-forming apparatus including photoreceptors produced by a method for producing a photoreceptor according to a first exemplary embodiment of the invention.

As shown in FIG. 2, an image-forming apparatus 1 includes image-forming sections 2Y, 2M, 2C, and 2K arranged in parallel at a predetermined spacing in the horizontal direction and corresponding to, for example, yellow (Y), magenta (M), cyan (C), and black (K), respectively. All the image-forming sections 2Y, 2M, 2C, and 2K have basically the same structure except for the toner used; as a general example, only the yellow (Y) image-forming section 2Y will be described with reference signs. The image-forming section 2Y includes a photoreceptor drum 3, as a photoreceptor, that is driven at a predetermined rotational speed in the arrow A direction; a charging roller 4, as a first charging unit, that uniformly charges the surface of the photoreceptor drum 3; an image exposure device 5, as a latent-image forming unit, that exposes the surface of the photoreceptor drum 3 to an image of the corresponding color to form an electrostatic latent image; a one-component or two-component developing device 6, as a developing unit, that develops the electrostatic latent image formed on the photoreceptor drum 3 with a toner of the corresponding color; and a cleaning device 7 that cleans the surface of the photoreceptor drum 3.

As shown in FIG. 2, the cleaning device 7 includes a cleaning blade 8 formed of, for example, urethane rubber. The cleaning blade 8, which is a doctor blade, has a base end located downstream in the rotational direction of the photoreceptor drum 3 and a leading end abutting the surface of the photoreceptor drum 3 in a direction opposite to the rotational direction of the photoreceptor drum 3 to remove, for example, toner or toner additive remaining on the surface of the photoreceptor drum 3.

In this exemplary embodiment, the photoreceptor drum 3, the charging roller 4, and the cleaning device 7 in each of the yellow (Y), magenta (M), cyan (C), and black (K) image-forming sections 2Y, 2M, 2C, and 2K are integrated into a process cartridge 20 in view of, for example, maintenance of the image-forming apparatus 1. These process cartridges 20 are attachable to and detachable from the image-forming apparatus 1 with a guide rail and a securing unit (not shown).

For example, if one of the photoreceptor drums 3 of the image-forming apparatus 1 reaches the end of its life, the user may replace the photoreceptor drum 3 by replacing the process cartridge 20 with a new one for maintenance of the image-forming apparatus 1.

The process cartridges 20 each include at least the photoreceptor drum 3; optionally, they may include another member such as the developing device 6, or may lack the charging roller 4 or the cleaning device 7.

In the yellow (Y), magenta (M), cyan (C), and black (K) image-forming sections 2Y, 2M, 2C, and 2K, as shown in FIG. 2, the surfaces of the photoreceptor drums 3 are charged by the charging rollers 4 and are exposed to images of the corresponding colors by the image exposure devices 5 to form electrostatic latent images. The electrostatic latent images formed on the surfaces of the photoreceptor drums 3 are then subjected to reversal development or normal development by the corresponding developing devices 6 to form yellow (Y), magenta (M), cyan (C), and black (K) toner images on the surfaces of the corresponding photoreceptor drums 3.

The toner images formed on the surfaces of the photoreceptor drums 3 of the yellow (Y), magenta (M), cyan (C), and black (K) image-forming sections 2Y, 2M, 2C, and 2K are transferred onto an intermediate transfer belt 10 by first transfer rollers 9Y, 9M, 9C, and 9K such that they are superimposed on each other, are transferred together by a second transfer roller 12 from the intermediate transfer belt 10 onto recording paper 11, as a recording medium, fed at a predetermined timing, and are fixed on the recording paper 11 by a fixing device 13, thus forming a full-color or monochrome image. The recording paper 11 is then discharged to a paper output tray 14 disposed outside the image-forming apparatus 1.

Whereas the intermediate transfer belt 10 is disposed below the image-forming sections 2Y, 2M, 2C, and 2K in the exemplary embodiment illustrated, the intermediate transfer belt 10 may be disposed above the image-forming sections 2Y, 2M, 2C, and 2K from the viewpoint of the arrangement of the image-forming apparatus 1.

As the recording paper 11, sheets of paper of desired size and material are separately fed one by one from a feed cassette 15 by a feed roller 16 and is transported to a second transfer position by a registration roller 17 in synchronization with the toner image on the intermediate transfer belt 10.

After the completion of the first transfer step described above, residual toner or toner additive is removed from the surfaces of the photoreceptor drums 3 by the cleaning blades 8 of the cleaning devices 7 to prepare for the next image-forming process. Similarly, after the completion of the second transfer step described above, residual toner or toner additive is removed from the surface of the intermediate transfer belt 10 by a belt cleaning device 18 to prepare for the next image-forming process.

Steps of Producing Photoreceptor

A photoreceptor used as a photoreceptor drum in the image-forming apparatus configured as described above is produced, for example, as follows.

Whereas various photoreceptors having photosensitive layers formed of inorganic or organic photoconductive materials are available, photoreceptors having photosensitive layers formed of organic photoconductive materials have often been used recently in view of, for example, environmental impact and productivity.

Figure 3A:
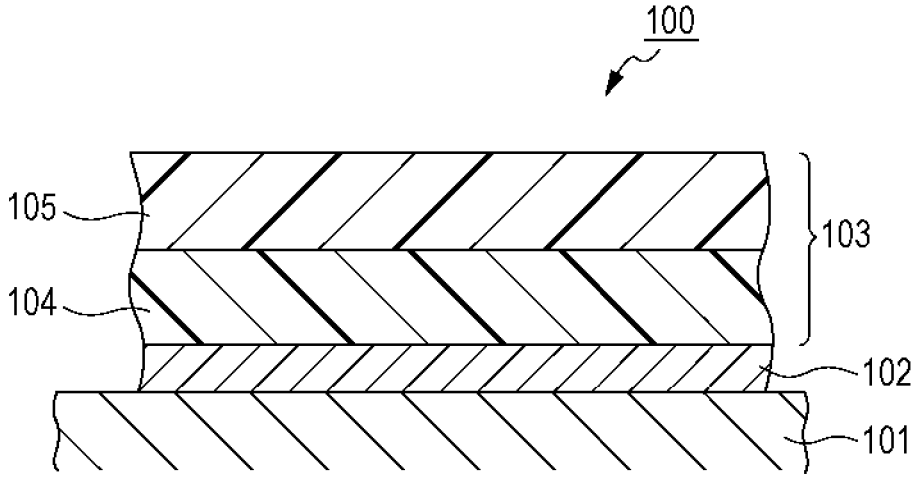
FIGS. 3A and 3B are sectional views showing photoreceptors produced by the method for producing a photoreceptor according to the first exemplary embodiment of the invention.

In this exemplary embodiment, as shown in FIG. 3A, a photoreceptor 100 generally includes, for example, a conductive substrate 101, an undercoat layer 102 as a coating layer, and a photosensitive layer 103 as a coating layer. The photosensitive layer 103 is composed of multiple layers with different functions, namely, a charge generating layer 104 that generates charge when exposed to light and a charge transport layer 105 that transports the charge generated by the charge generating layer 104, although the photosensitive layer 103 used is not limited thereto, but may be composed of a single layer functioning both as the charge generating layer 104 and as the charge transport layer 105.

Figure 3B:
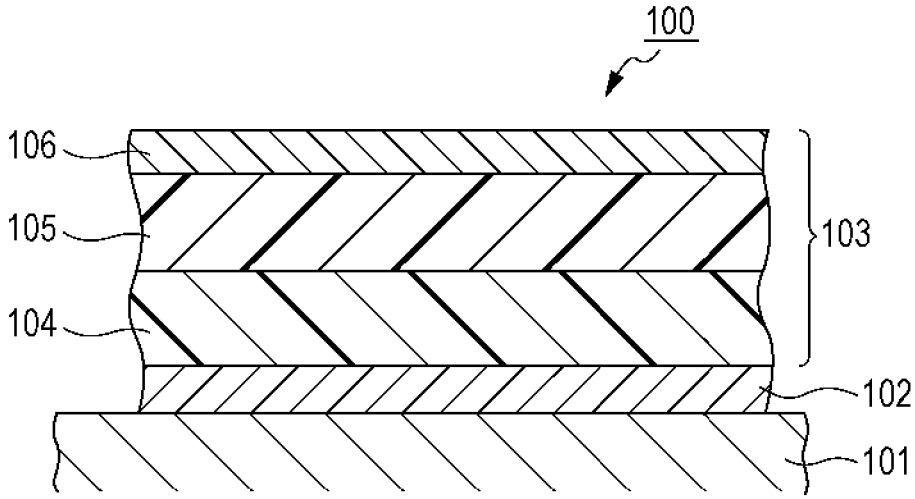

As shown in FIG. 3B, the photoreceptor 100 may have a surface layer 106 formed on the surface of the photosensitive layer 103 as a coating layer. The layer structure of the photoreceptor 100 is not limited to the above structure, but may include a larger or smaller number of layers than the above layer structure. For example, the undercoat layer 102 and the surface layer 106 may be omitted.

Conductive-Substrate Preparing Step

The conductive substrate 101 used may be any conductive substrate used in the related art. Examples of conductive substrates include metal substrates such as aluminum, nickel, chromium, and stainless steel substrates and insulating substrates having conductive materials applied or deposited thereon.

The conductive substrate 101 is formed in a cylindrical or substantially cylindrical shape with a predetermined outer diameter. As the conductive substrate 101, for example, a metal pipe may be used as it is. A metal pipe may be used as produced or may be subjected to surface treatment such as mirror grinding, etching, anodizing, rough cutting, centerless grinding, sand blasting, or wet honing.

Layer-Forming Step

In a layer-forming step, at least the photosensitive layer 103 is formed as a coating layer on the surface of the conductive substrate 101 prepared as described above.

As shown in FIGS. 3A and 3B, the undercoat layer 102 is optionally formed on the surface of the conductive substrate 101 before the coating layer such as the photosensitive layer 103 is formed. The undercoat layer 102 is provided, for example, to prevent reflection and scattering of light on the surface of the conductive substrate 101 and to prevent an undesired flow of carriers (countercharge) from the conductive substrate 101 to the photosensitive layer 103 as the surface of the photosensitive layer 103 is charged.

The undercoat layer 102 does not necessarily have to be formed in the layer-forming step, but may be formed in the step of preparing the conductive substrate 101 described above.

The undercoat layer 102 may be formed of, for example, a powder of a metal such as aluminum, copper, nickel, or silver, a conductive metal oxide such as antimony oxide, indium oxide, tin oxide, or zinc oxide, or a conductive material such as carbon fiber, carbon black, or graphite, dispersed in a binder resin and applied to the conductive substrate 101.

Although not shown, an intermediate layer may be further provided on the undercoat layer 102 for purposes such as improved electrical properties, improved image quality, improved image durability, and improved adhesion of the photosensitive layer 103.

The charge generating layer 104 is formed of a charge generating material dispersed in a suitable binder resin. Examples of charge generating materials include phthalocyanine pigments such as metal-free phthalocyanine, chlorogallium phthalocyanine, hydroxygallium phthalocyanine, dichlorotin phthalocyanine, and titanyl phthalocyanine. These charge generating materials may be used alone or as a mixture of two or more.

Examples of binder resins used for the charge generating layer 104 include polycarbonate resins such as those of bisphenol A or bisphenol Z type, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate copolymer resins, vinyl chloride-vinyl acetate-maleic anhydride copolymer resins, silicone resins, phenolic-formaldehyde copolymer resins, polyacrylamide resins, polyamide resins, and poly-N-vinylcarbazole resins. These binder resins may be used alone or as a mixture of two or more.

The resulting coating solution containing the material of the charge generating layer 104 may be applied to the undercoat layer 102 by, for example, dip coating, lift coating, wire bar coating, spray coating, blade coating, ring coating, knife coating, or curtain coating. The thickness of the charge generating layer 104 is set to, for example, 0.01 to 5 μm.

On the other hand, the charge transport layer 105, as shown in FIG. 3A, forms the outermost layer located on the outermost side of the photoreceptor 100 according to this exemplary embodiment. The charge transport layer 105 is formed of a charge transport material dispersed in a suitable binder resin. Examples of charge transport materials include oxadiazoles such as 2,5-bis(p-diethylaminophenyl)-1,3,4-oxadiazole; pyrazolines such as 1,3,5-triphenylpyrazoline and 1-[pyridyl-(2)]-3-(p-diethylaminostyryl)-5-(p-diethylaminostyryl)pyrazoline; aromatic tertiary amino compounds such as triphenylamine, N,N'-bis(3,4-dimethylphenyl)biphenyl-4-amine, tri(p-methylphenyl)aminyl-4-amine, and dibenzylaniline; aromatic tertiary diamino compounds such as N,N'-bis(3-methylphenyl)-N,N'-diphenylbenzidine; 1,2,4-triadines such as 3-(4'-dimethylaminophenyl)-5,6-di(4'-methoxyphenyl)-1,2,4-triadine; hydrazones such as 4-diethylaminobenzaldehyde-1,1-diphenylhydrazone; quinazolines such as 2-phenyl-4-styrylquinazoline; benzofurans such as 6-hydroxy-2,3-di(p-methoxyphenyl)benzofuran; α-stilbenes such as p-(2,2-diphenylvinyl)-N,N-diphenylaniline; enamines; carbazoles such as N-ethylcarbazole; hole transport materials such as poly-N-vinylcarbazole and derivatives thereof; quinones such as chloranil and bromoanthraquinone; tetracyanoquinodimethanes; fluorenones such as 2,4,7-trinitrofluorenone and 2,4,5,7-tetranitro-9-fluorenone; xanthones; electron transport materials such as thiophenes; and polymers having groups having the above compounds in the main chain or side chain thereof. These charge transport materials may be used alone or in a combination of two or more.

Examples of binder resins used for the charge transport layer 105 include polycarbonate resins such as those of bisphenol A or bisphenol Z type, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride copolymer resins, silicone resins, phenolic-formaldehyde copolymer resins, polyacrylamide resins, polyamide resins, chlorine rubbers, and organic photoconductive polymers such as polyvinylcarbazole, polyvinylanthracene, and polyvinylpyrene. These binder resins may be used alone or as a mixture of two or more.

The resulting coating solution for forming the charge transport layer 105 may be applied to the charge generating layer 104 by a common method such as dip coating, lift coating, wire bar coating, spray coating, blade coating, ring coating, knife coating, or curtain coating. The thickness of the charge transport layer 105 is set to, for example, 5 to 50 μm.

In addition, additives such as an antioxidant, a light stabilizer, and a heat stabilizer may be added to the layers forming the photosensitive layer 103 to prevent deterioration of the photoreceptor 100 due to ozone and nitrogen oxide produced in an image-forming apparatus or due to light or heat.

If the photoreceptor 100 having the coating layers formed by coating and curing as described above is incorporated into the image-forming apparatus 1 as it is for use as the photoreceptor drum 3, the as-produced photoreceptor 100 has a mirror surface or nearly mirror surface with extremely low surface roughness due to, for example, the method for forming the coating layers, the properties of the materials of the coating layers, and the additive added to ensure uniform thickness.

Accordingly, if the photoreceptor 100 is incorporated into the image-forming apparatus 1 as it is as the photoreceptor drum 3, the edge of the cleaning blade 8, which often has relatively low hardness in view of, for example, cleaning performance, tends to adhere to the surface of the photoreceptor 100. As a result, the cleaning blade 8 has an excessive coefficient of static friction and coefficient of kinetic friction μ on the surface of the photoreceptor 100. This tends to cause problems such as "blade noise" (unusual sound due to fine vibrations of the edge of the cleaning blade 8), "turning up" (inversion of the edge of the cleaning blade 8 to the downstream side in the rotational direction of the photoreceptor drum 3), and "chipping" (chipping of the edge of the cleaning blade 8). In particular, the problems such as "blade noise," "turning up," and "chipping" of the cleaning blade 8 tend to occur noticeably when a relatively soft cleaning blade with relatively low rubber hardness (JIS-A hardness) is used in view of, for example, cleaning performance.

Figure 4:
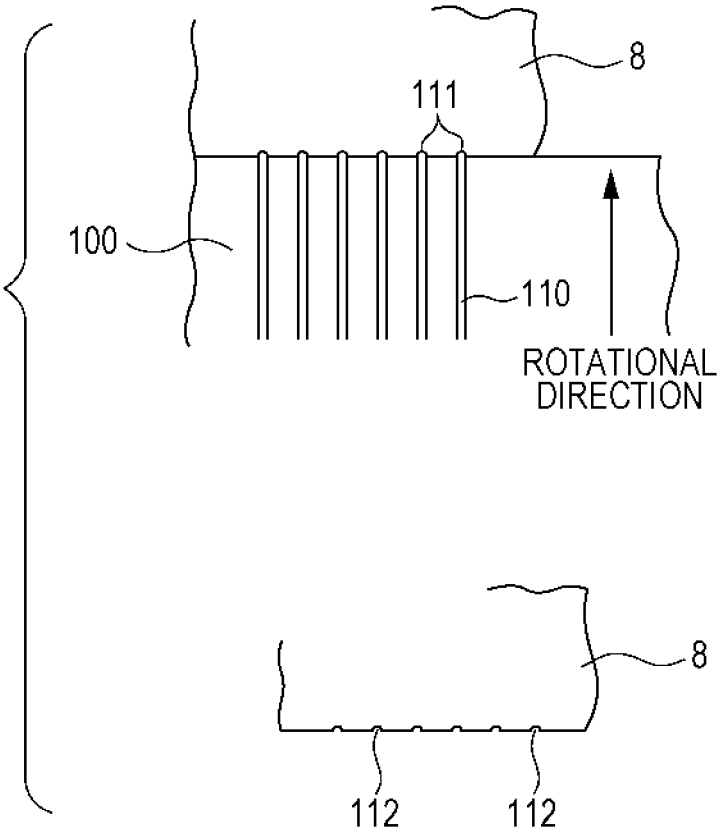
FIG. 4 is a set of schematic diagrams showing the wear condition of a cleaning blade.

Accordingly, a technique for deliberately roughening the surface of the photoreceptor 100 during production has been employed. To roughen the surface of the photoreceptor 100, the photoreceptor 100 is rotated with a polishing member in contact with the surface thereof. As a result, as shown in FIG. 4, lines 110 due to polishing are formed on the surface of the photoreceptor 100 in the rotational direction (circumferential direction) of the photoreceptor 100.

However, if the rotational direction of the photoreceptor 100 is identical to the polishing direction, as described above, ridges and grooves are formed on the surface of the photoreceptor 100 at the same positions in the axial direction of the photoreceptor 100 after the polishing. According to research by the inventors, if the photoreceptor 100 thus polished is used, ridges 111 of the lines 110 due to polishing formed on the surface of the photoreceptor 100 by polishing wear the edge of the cleaning blade 8 like a file during image formation. As a result, as shown in FIG. 4, the edge of the cleaning blade 8 is worn at the same positions 112 in the axial direction of the photoreceptor 100 by the ridges 111 of the lines 110 due to polishing formed on the surface of the photoreceptor 100. Accordingly, the wear condition of the cleaning blade 8 varies in the axial direction of the photoreceptor 100. At severely worn positions, some toner or toner additive leaks through the cleaning blade 8, thus leading to degraded image quality due to contamination of the charging roller 4 and smudges of the leaking toner on the background of an image. In addition, the local wear of the cleaning blade 8 varies the wear condition of the photoreceptor 100, which results in unevenness in image quality, such as density, in the axial direction of the photoreceptor 100. Thus, the wear of the cleaning blade 8 at the same positions 112 has influences on images.

As a result of intensive research, the inventors have invented a polishing step as described below in addition to the method for producing the photoreceptor 100 described above.

In addition to the layer-forming step of forming at least the photosensitive layer 103 as a coating layer on the surface of the cylindrical or substantially cylindrical conductive substrate 101 described above, the method for producing the photoreceptor 100 according to this exemplary embodiment includes a polishing step of polishing the surface of the coating layer formed on the conductive substrate 101 in the layer-forming step by rotating the conductive substrate 101 and moving a polishing member in a direction crossing the circumferential direction of the conductive substrate 101 in contact with the surface of the coating layer on the conductive substrate 101.

Polishing Step

The photoreceptor 100 having the coating layers formed as described above is not attached as it is to the process cartridge 20 to be mounted on the image-forming apparatus 1; the surface of the photoreceptor 100 is polished in a polishing step as one of a series of production steps continuous with the above steps of producing the photoreceptor 100 or as one of the production steps temporally and/or spatially separated from the above steps of producing the photoreceptor 100.

Figure 5:
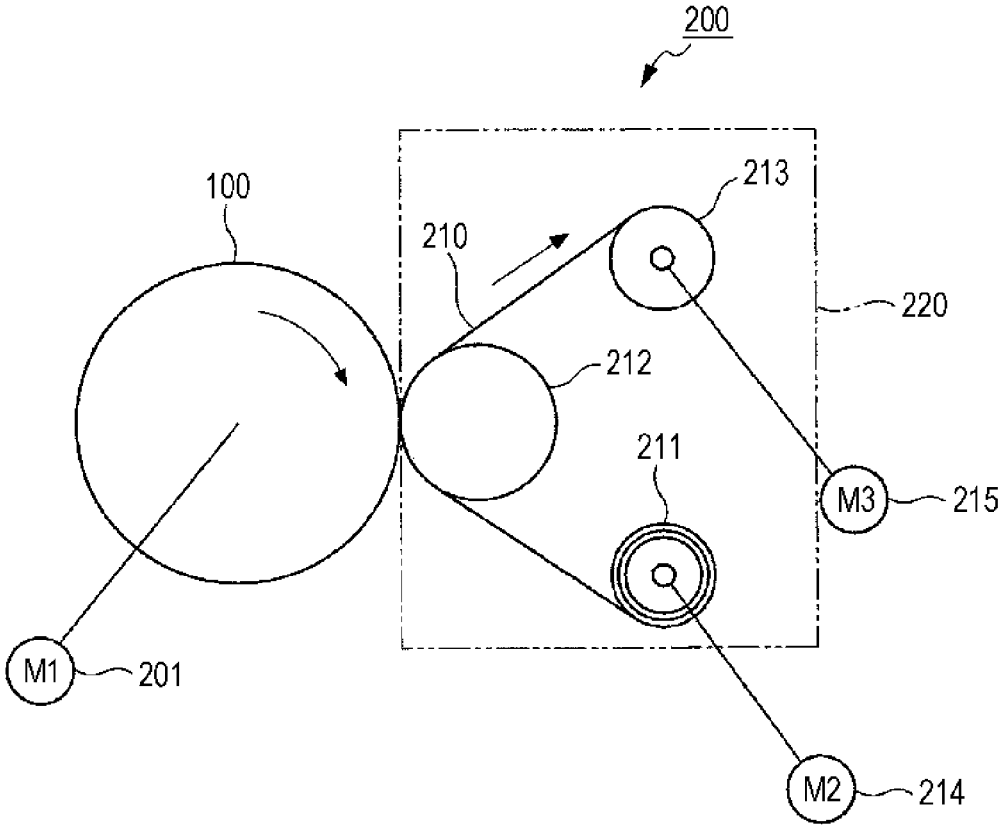
FIG. 5 is a schematic diagram showing a polishing apparatus.

As shown in FIG. 5, the photoreceptor 100 having the coating layers formed as described above is attached to a drive unit 201 that rotates the photoreceptor 100 in a polishing apparatus 200 and is rotated at a predetermined rotational speed. The rotational speed of the photoreceptor 100 is not limited and may be set to any speed, for example, the same speed as the rotational speed (process speed) of the photoreceptor drum 3 in the image-forming apparatus 1 or a speed lower or higher than the rotational speed of the photoreceptor drum 3. In view of, for example, the number of photoreceptors that can be polished per unit time, that is, the productivity of the polishing step, it is desirable to set the rotational speed of the photoreceptor 100 to a speed higher than the rotational speed of the photoreceptor drum 3.

Although there is no upper or lower limit on the rotational speed (movement speed) of the photoreceptor 100, it may be set to, for example, 100 to 1,500 rpm for a photoreceptor having a diameter of 40 mm in view of, for example, the precision and productivity of the polishing step. A rotational speed below 100 rpm causes no problem with the accuracy of the polishing step, although such a rotational speed is undesirable in that the productivity decreases because it takes a longer period of time to polish the surface of each photoreceptor. On the other hand, a rotational speed above 1,500 rpm is desirable in terms of productivity because it takes a shorter period of time to polish the surface of each photoreceptor, although an excessive rotational speed is undesirable in that it may cause damage to the surface layer of the photoreceptor 100 due to, for example, frictional heat from contact with the polishing member. It is to be understood, however, that the rotational speed of the photoreceptor 100 may be set to a speed higher than 1,500 rpm as long as damage to the surface layer of the photoreceptor 100 is avoided, for example, by polishing the surface layer while cooling it.

Figure 1A:
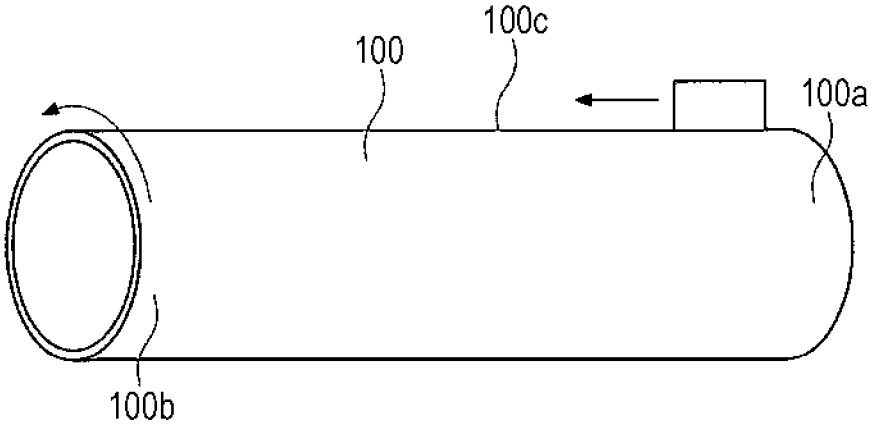
FIGS. 1A and 1B are schematic diagrams showing a method for producing a photoreceptor according to a first exemplary embodiment of the invention.
Figure 1B:
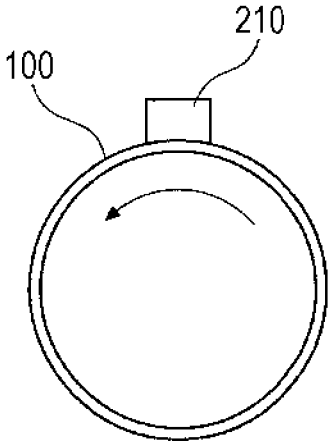

As shown in FIG. 5, a polishing member 210 is disposed in contact with the surface of the photoreceptor 100. In the polishing step, as shown in FIGS. 1A and 1B, the outermost surface of the coating layers of the photoreceptor 100 is polished by moving the polishing member 210 in a direction crossing the circumferential direction (rotational direction) of the photoreceptor 100 at a predetermined movement speed.

The polishing member 210 is not limited and may be any polishing member that can polish the surface of the photoreceptor 100 to roughen the surface. Examples of polishing members include polishing sheets, polishing rollers, polishing brushes, and polishing wheels.

Among such polishing members, for example, a polishing sheet 210 such as one known as a lapping film sheet is available. A lapping film sheet is, for example, a synthetic resin film, such as a polyester film, having uniform thickness and a smooth surface coated with abrasive grains having a predetermined grain size distribution and formed of, for example, aluminum oxide. A lapping film sheet coated with abrasive grains of controlled size may be used as the polishing sheet 210 to perform uniform ultraprecision polishing to a surface roughness, namely, calculated average roughness (Ra), of a minimum of about 0.01 μm. In addition, a lapping film sheet is economical and suitable for polishing the surface of the photoreceptor 100 because the desired surface roughness is achieved by easy polishing treatment in a short period of time.

As the polishing sheet 210, for example, ones having fine aluminum oxide particles with varying grain sizes, such as 0.3 μm, 1 μm, 3 μm, 5 μm, 10 μm, 30 μm, 40 μm, and 60 μm, are available, and one having a predetermined grain size is selected depending on the desired polished condition of the surface of the photoreceptor 100.

The length (width) of the polishing sheet 210 in the axial direction of the photoreceptor 100 may be set to, for example, but not limited to, about 10 to 100 mm. It is to be understood, however, that the width of the polishing sheet 210 is not limited to the above range and may be shorter or longer than that range.

Whereas the polishing sheet 210 may be used as it is in sheet form, as shown in FIG. 5, it may be formed in an elongated strip shape having a predetermined width and be wound around a polishing sheet supply roller 211 for use as a roll. In this case, the polishing sheet 210 may be gradually supplied and taken up while polishing the surface of the photoreceptor 100 to polish the surface of the photoreceptor 100 while sequentially replacing the polishing surface of the polishing sheet 210 with a new surface. This is desirable in terms of automation and speedup of the polishing step.

For example, as shown in FIG. 5, the polishing apparatus 200 using the strip-shaped polishing sheet 210 is configured such that the strip-shaped polishing sheet 210 is supplied from the polishing sheet supply roller 211 to the polishing position in contact with the surface of the photoreceptor 100 directly or optionally via one or more guide rollers and is pressed against the surface of the photoreceptor 100 at a predetermined pressure by a press roller 212, such as a rubber roller, that presses the surface of the photoreceptor 100 with the polishing sheet 210 therebetween, and is taken up by a take-up roller 213 directly or optionally via one or more guide rollers.

The pressure at which the polishing sheet 210 is pressed against the surface of the photoreceptor 100, which directly affects the polishing properties of the surface of the photoreceptor 100, is set together with, for example, the surface roughness of the polishing sheet 210 so as to achieve the desired polished condition of the surface of the photoreceptor 100.

In the polishing apparatus 200, as shown in FIG. 5, the polishing sheet supply roller 211 and the take-up roller 213 are independently rotated by drive motors 214 and 215 provided for the polishing sheet supply roller 211 and the take-up roller 213, respectively, and the polishing sheet 210 is supplied and taken up in contact with the surface of the photoreceptor 100 with a predetermined tension being applied thereto in advance.

The feed direction of the polishing sheet 210 may be set to be identical to the rotational direction of the photoreceptor 100 or may be set to be opposite to the rotational direction of the photoreceptor 100. In this exemplary embodiment, as shown in FIG. 5, the feed direction of the polishing sheet 210 is set to be opposite to the rotational direction of the photoreceptor 100 at the position in contact with the photoreceptor 100.

As shown in FIG. 5, the polishing apparatus 200 is attached to a housing 220. As shown in FIGS. 1A, 1B, and 5, the housing 220 is configured to be movable along a guide rail (not shown) from one end to the other end of the photoreceptor 100 in a direction crossing the circumferential direction of the photoreceptor 100, that is, in the axial direction of the photoreceptor 100. The movement direction of the polishing apparatus 200 does not necessarily have to be identical to the axial direction of the photoreceptor 100, but may be set such that the polishing apparatus 200 is movable at an angle with respect to the axial direction of the photoreceptor 100.

The housing 220 is movable at a predetermined movement speed in the axial direction of the photoreceptor 100 by a moving unit such as a ball screw or a timing belt (not shown).

The polishing apparatus 200 is configured such that the movement direction of the housing 220 can be switched by reversing the movement direction of the moving unit, such as a ball screw or a timing belt. As shown in FIG. 1A, the housing 220 is configured to be movable from one end 100*a* to the other end 100*b* multiple times such that it is moved from the end 100*a* to the other end 100*b* in the axial direction of the photoreceptor 100, is returned to the end 100*a* in the axial direction of the photoreceptor 100, with the polishing sheet 210 separated from the surface 100*c* of the photoreceptor 100, and is moved again from the end 100*a* to the other end 100*b* in the axial direction of the photoreceptor 100, with the polishing sheet 210 in contact with the surface 100*c* of the photoreceptor 100:

Alternatively, the housing 220 is configured to be movable back and forth between the two ends 100*a* and 100*b* any number of times, for example, multiple times, such that it is moved from the end 100*a* to the other end 100*b* in the axial direction of the photoreceptor 100 and is then returned from the other end 100*b* to the end 100*a*, with the polishing sheet 210 kept in contact with the surface 100*c* of the photoreceptor 100.

Figure 7A:
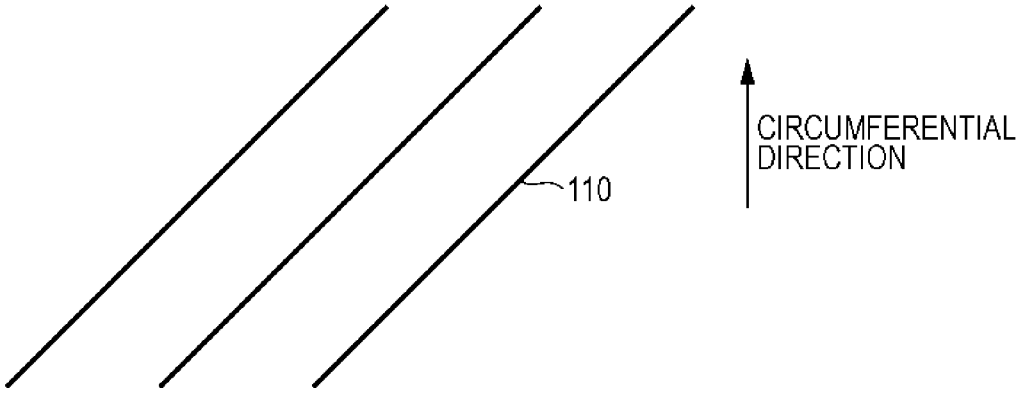
FIGS. 7A and 7B are schematic diagrams showing the directions of lines due to polishing.
Figure 7B:
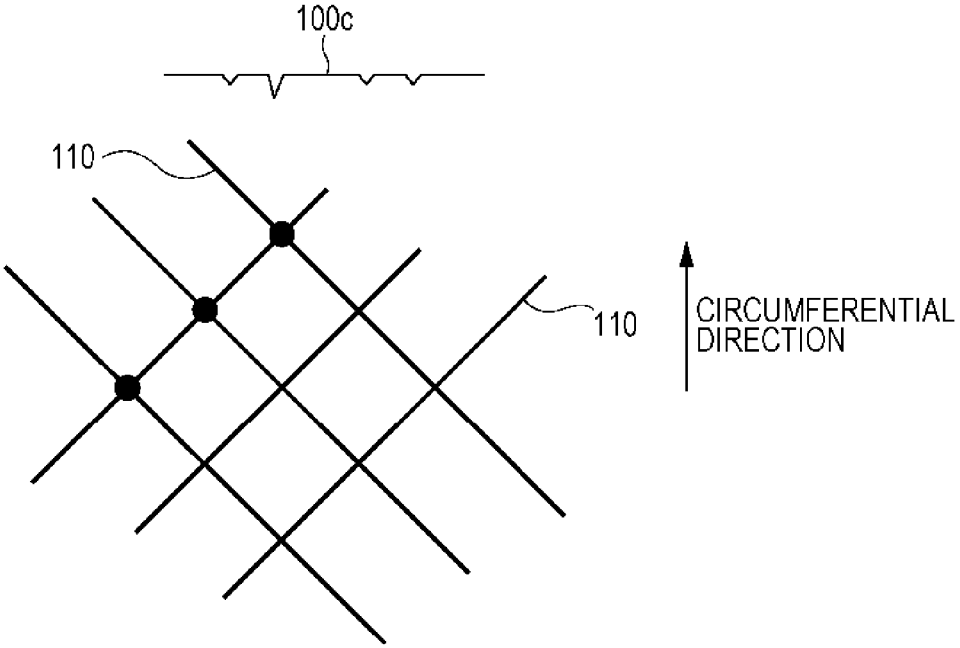

As shown in FIG. 7A, if the polishing member 210 is moved from the end 100*a* to the other end 100*b* in the axial direction of the photoreceptor 100 multiple times, as described above, lines 110 due to polishing having fine ridges and grooves inclined with respect to the rotational direction of the photoreceptor 100 are formed so as to be inclined in the same direction. As shown in FIG. 7B, on the other hand, if the polishing member 210 is moved back and forth in the axial direction of the photoreceptor 100, the lines 110 due to polishing having fine ridges and grooves inclined with respect to the rotational direction of the photoreceptor 100 are formed so as to cross each other. The ridges and grooves formed by polishing are likely to be larger at the intersections of the lines 110 due to polishing inclined with respect to the rotational direction of the photoreceptor 100 than at other positions.

Figure 6:
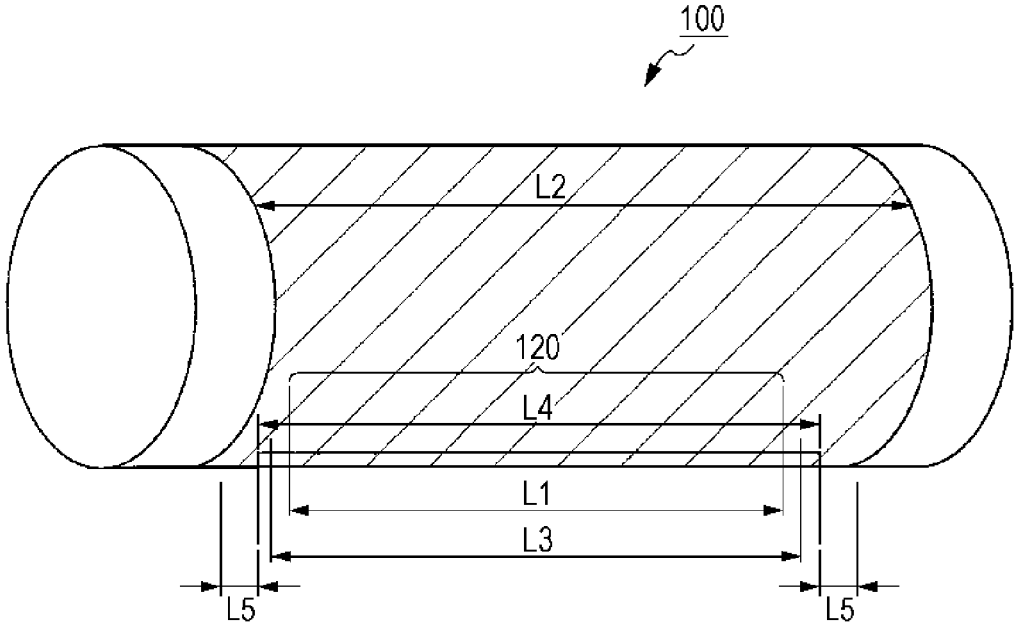
FIG. 6 is a perspective view showing a polishing region on the photoreceptor produced by the method for producing a photoreceptor according to the first exemplary embodiment of the invention.

As shown in FIG. 1A, the distance (polishing distance) over which the housing 220 is moved in the axial direction of the photoreceptor 100 is determined depending on the length of the photoreceptor 100 in the axial direction, although the housing 220 does not necessarily have to be moved over the entire length of the photoreceptor 100 in the axial direction; it may be moved over the required distance in the axial direction of the photoreceptor 100, for example, over the length of an image region on the photoreceptor 100. As shown in FIG. 6, the length L1 of an image region 120 on the photoreceptor 100 is determined depending on, for example, the length (width) of the recording paper 11 over which an image can be formed by the image-forming apparatus 1. As shown in FIG. 6, the polishing distance L2 of the photoreceptor 100 is set to be longer than the length L1 of the image region 120 on the photoreceptor 100 taking into account, for example, the length L3 of the charging roller 4 in the axial direction and the cleaning width L4 of the cleaning blade 8, specifically, to be longer than the cleaning width L4 of the cleaning blade 8 in the axial direction of the photoreceptor 100 by a width L5 as a margin for each side.

The movement speed of the housing 220 of the polishing apparatus 200, which may be set to any speed, is set in view of, for example, the rotational speed of the photoreceptor 100 and productivity. The movement speed of the housing 220 of the polishing apparatus 200 is set to, for example, about 25 to 100 mm/sec. It is to be understood, however, that the movement speed may be lower or higher than the above range. The movement speed of the housing 220, as well as the rotational speed of the photoreceptor 100, is one of the factors that determine the number of times the surface of the photoreceptor 100 is polished at the same position.

That is, the larger the ratio of the rotational speed of the photoreceptor 100 to the movement speed of the polishing apparatus 200, the larger the number of times the surface of the photoreceptor 100 is polished at the same position tends to be. Conversely, the smaller the ratio of the rotational speed of the photoreceptor 100 to the movement speed of the polishing apparatus 200, the smaller the number of times the surface of the photoreceptor 100 is polished at the same position tends to be.

If the diameter (outer diameter) of the photoreceptor 100 is 40 mm (circumference: about 125.7 mm), the rotational speed of the photoreceptor 100 is 320 mm/sec, and the time taken for the housing 220 of the polishing apparatus 200 to move from the end 100*a* to the other end 100*b* of the photoreceptor 100 is 30 seconds (the movement speed of the polishing apparatus 200: about 11 mm/sec), it takes about 0.4 second for the photoreceptor 100 to make one turn, during which the polishing sheet 210 of the polishing apparatus 200 is moved by a distance of 4 to 5 mm.

As a result, the surface of the photoreceptor 100 is polished at the same position about twice by the polishing sheet 210. The number of times the surface of the photoreceptor 100 is polished, as well as the surface roughness of the polishing sheet 210, is one of the factors that determine the polished condition of the surface of the photoreceptor 100.

As used herein, the number of times the surface of the photoreceptor 100 is polished means how many times the polishing sheet 210 contacts and polishes the same position of the surface of the photoreceptor 100 while moving from the end 100*a* to the other end 100*b* of the photoreceptor 100 in a single polishing process; it does not mean how many times the polishing sheet 210 is moved from the end 100*a* to the other end 100*b* of the photoreceptor 100, that is, the number of times the polishing process is executed.

As described above, the number of times the surface of the photoreceptor 100 is polished is determined by the rotational speed of the photoreceptor 100 and the width and movement speed of the polishing sheet 210. Assume that a polishing sheet 210 having a width of 10 mm in the axial direction of the photoreceptor 100 is moved in the axial direction of the photoreceptor 100 while rotating the photoreceptor 100 at a rotational speed of 335 mm/sec to form polishing grooves inclined with respect to the rotational direction (circumferential direction) on the surface of the photoreceptor 100. The movement speed of the polishing sheet 210 is set such that the ratio of the movement speed of the polishing sheet 210 to the rotational speed of the photoreceptor 100 is, for example, 1:5 to 1:50 or about 1:5 to 1:50. That is, if the rotational speed of the photoreceptor 100 is 335 mm/sec, the movement speed of the polishing sheet 210 is set to, for example, about 25 to 100 mm/sec. It is to be understood, however, that the movement speed of the polishing sheet 210 is not limited to the above range but may be higher or lower than that range.

According to the results of research by the inventors, as demonstrated by the experimental results described later, it is desirable that the polished condition of the surface of the photoreceptor 100 be equivalent to the condition of a new, unpolished photoreceptor 100 after formation of images on about 3,000 sheets of A4 size recording paper 11 for short edge feed, where the load torque measured when the photoreceptor 100 is rotated with the cleaning blade 8 being pressed against the surface thereof converges to a certain value with little variation. According to the results of research by the inventors, as the wear condition of the surface of the photoreceptor 100 after formation of images on about 3,000 sheets, a calculated average roughness (Ra) of about 0.01 μm and a maximum height (Rmax) of about 0.1 μm are desirable.

Assembly Step

Figure 8:
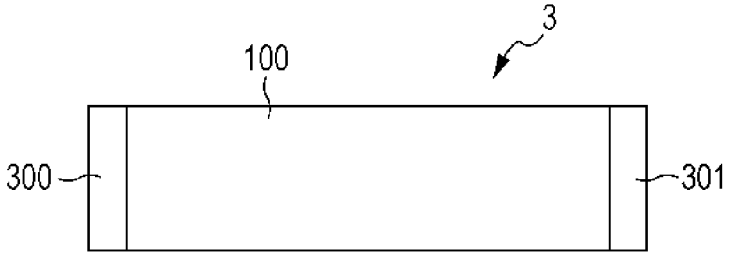
FIG. 8 is a schematic diagram showing a photoreceptor drum produced using the photoreceptor produced by the method for producing a photoreceptor according to the first exemplary embodiment of the invention.

As shown in FIG. 8, a flange member 300 with which the photoreceptor 100 is attached to the process cartridge 20 so as to be rotatable and a flange member 301 having a gear as a drive unit are attached to either end of the photoreceptor 100 produced as described above in the axial direction, for example, in the steps of producing the photoreceptor 100 or in the steps of assembling the process cartridge 20.

Figure 9:
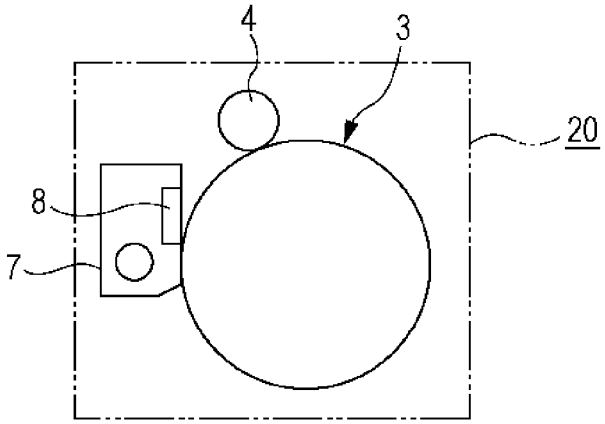
FIG. 9 is a schematic diagram showing a process cartridge produced using the photoreceptor produced by the method for producing a photoreceptor according to the first exemplary embodiment of the invention.

As shown in FIG. 9, the photoreceptor drum 3, configured by attaching the flange members 300 and 301 to either end of the photoreceptor 100 in the axial direction, is attached to a frame (not shown) of the process cartridge 20 with the flange members 300 and 301 so as to be rotatable.

As shown in FIG. 9, additionally, the charging roller 4 and the cleaning device 7 are attached around the photoreceptor drum 3 to assemble and produce the process cartridge 20.

As shown in FIG. 2, the process cartridge 20 thus produced is attached to each of the image-forming sections 2Y, 2M, 2C, and 2K of the image-forming apparatus 1, for example, with a guide rail (not shown), followed by wiring of the charging roller 4 and the developing device 6 and attachment of components, such as drive motors and gears, constituting drive systems that drive the charging roller 4, the developing device 6, and the cleaning device 7, thus producing the image-forming apparatus 1.

In the process cartridge 20 and the image-forming apparatus 1 including the photoreceptor 100 produced by the method for producing a photoreceptor according to this exemplary embodiment, the polished surface of the photoreceptor 100 causes few local image defects in the axial direction of the photoreceptor 100 due to wear of the cleaning blade 8 at the same positions during image formation, as described below.

That is, as shown in FIGS. 1A and 1B, in the polishing step of the method for producing a photoreceptor according to this exemplary embodiment, the surface of the coating layers formed on the conductive substrate 101 of the photoreceptor 100 is polished by, as shown in FIG. 5, rotating the photoreceptor 100 and moving the polishing sheet 210 in the axial direction of the photoreceptor 100 in contact with the surface of the coating layers of the photoreceptor 100.

Figure 10:
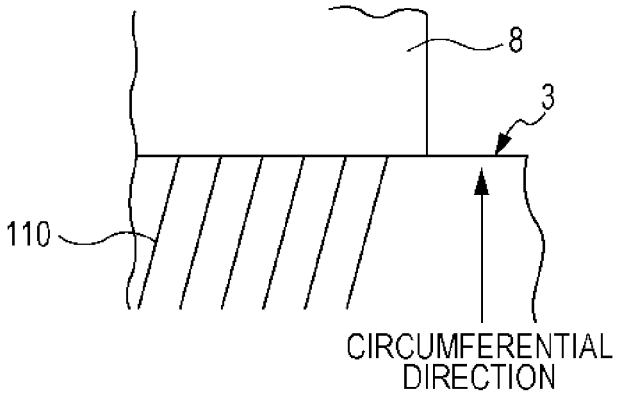
FIG. 10 is a schematic diagram showing the wear condition of a cleaning blade.

As a result, as shown in FIGS. 7A and 7B, the ridges and grooves of the lines 110 due to polishing are formed on the surface 100*c* of the photoreceptor 100 by the polishing sheet 210. The ridges and grooves of the lines 110 due to polishing are formed so as to be inclined with respect to the circumferential direction of the photoreceptor 100. Accordingly, if the photoreceptor drum 3 is formed using the photoreceptor 100 and is attached to the image-forming apparatus 1 for use, the edge of the cleaning blade 8 is not constantly worn at the same positions by the ridges of the lines 110 due to polishing because, as shown in FIG. 10, the ridges and grooves of the lines 110 due to polishing formed on the surface 100*c* of the photoreceptor 100 are inclined with respect to the circumferential direction (rotational direction) of the photoreceptor 100. Thus, the edge of the cleaning blade 8 is worn substantially uniformly in the axial direction of the photoreceptor 100.

Accordingly, the use of the photoreceptor 100 produced by the method for producing a photoreceptor according to this exemplary embodiment avoids or reduces wear of the edge of the cleaning blade 8 at the same positions 112 in the axial direction of the photoreceptor 100. This avoids or reduces adverse influences on images, including leakage of some toner or toner additive through the cleaning blade 8, degraded image quality due to contamination of the charging roller 4, smudges of the leaking toner on the background of an image, uneven wear in the axial direction of the photoreceptor 100, and unevenness in image quality in the axial direction of the photoreceptor 100.

EXAMPLES

To examine the conditions under which the surface of a photoreceptor is polished in the above method for producing a photoreceptor, the inventors conduct an experiment in which photoreceptors produced by the above method for producing a photoreceptor are mounted on a benchmark model of an image-forming apparatus and are examined for surface condition, specifically, surface roughness, drive torque, and microscopic surface appearance.

In Example 1, as shown in FIGS. 1A and 1B, the photoreceptor 100 is polished by moving the polishing sheet 210 twice in one direction along the axial direction in 90 seconds. In Example 2, the photoreceptor 100 is polished by moving the polishing sheet 210 back and forth in the axial direction in 60 seconds. In Example 3, the photoreceptor 100 is polished by moving the polishing sheet 210 back and forth in the axial direction at twice the speed of Example 2 in 30 seconds. In a comparative example, the photoreceptor 100 is not polished. In another comparative example, the photoreceptor 100 is manually polished using a 3,000 grit polishing sheet.

Surface Roughness

Figure 12:
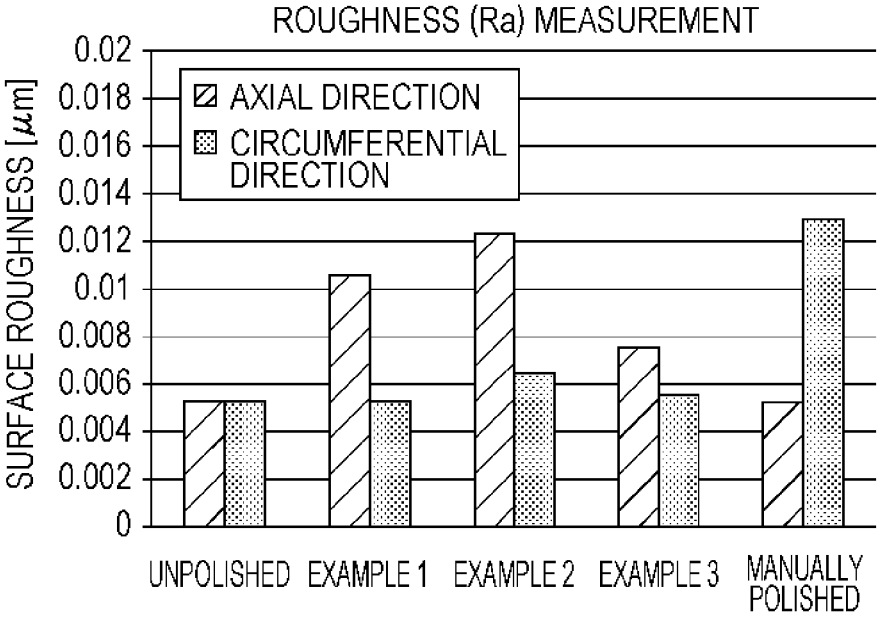
FIG. 12 is a graph showing the surface roughness of the photoreceptors produced by the method for producing a photoreceptor according to the first exemplary embodiment of the invention.
Figure 13:
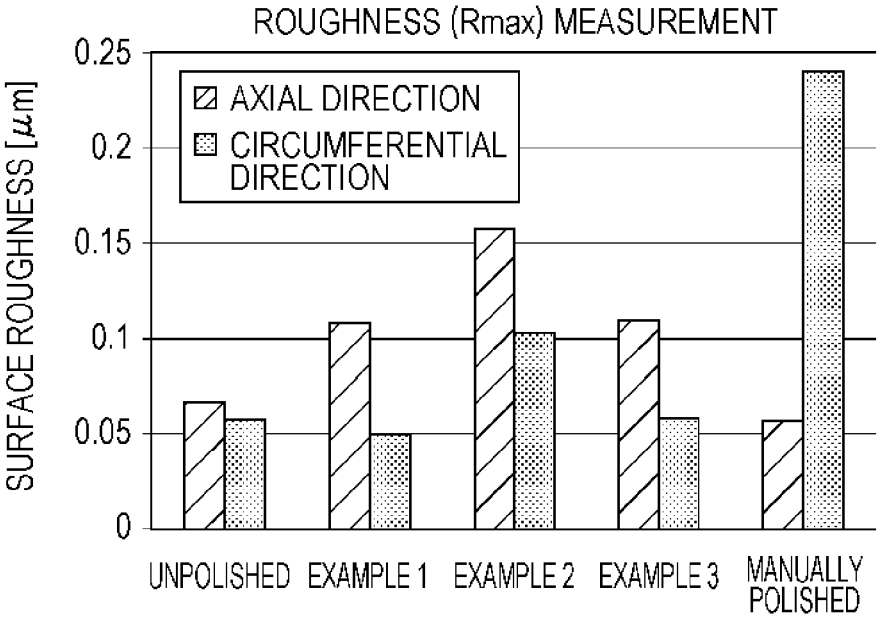
FIG. 13 is a graph showing the surface roughness of the photoreceptors produced by the method for producing a photoreceptor according to the first exemplary embodiment of the invention.
Figure 15:
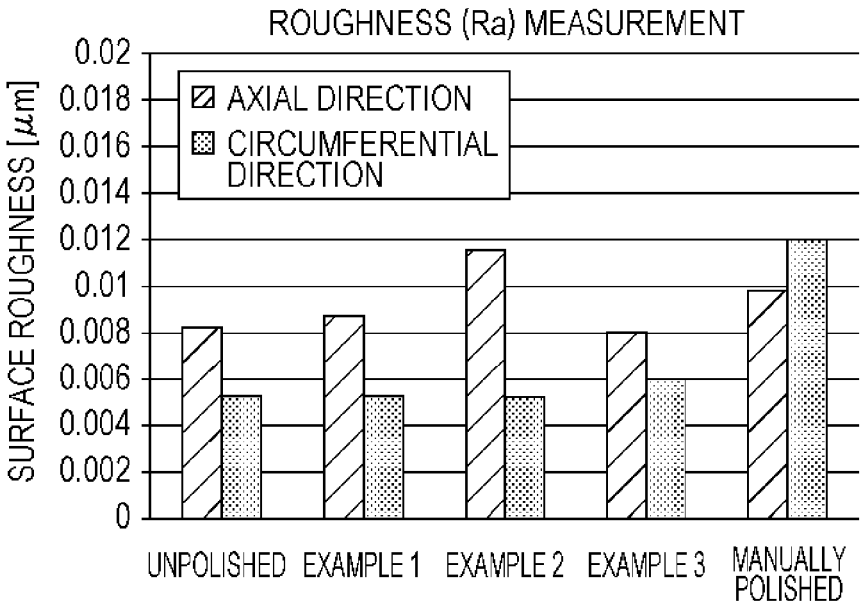
FIG. 15 is a graph showing the surface roughness of the photoreceptors produced by the method for producing a photoreceptor according to the first exemplary embodiment of the invention.
Figure 16:
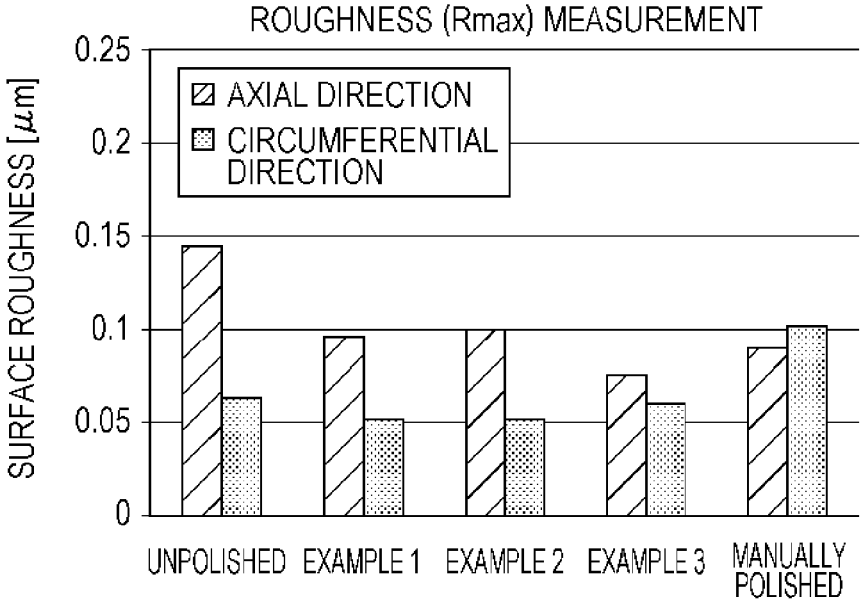
FIG. 16 is a graph showing the surface roughness of the photoreceptors produced by the method for producing a photoreceptor according to the first exemplary embodiment of the invention.

FIGS. 11 to 13 show the measurement results of the surface roughness of the photoreceptor drums immediately after polishing in the axial direction and the circumferential direction based on JIS B0601. In addition, FIGS. 14 to 16 show the measurement results of the surface roughness of the photoreceptor drums after formation of images on 3,000 sheets in the axial direction and the circumferential direction based on JIS B0601.

First, as shown in FIGS. 11 to 13, the calculated average roughness (Ra) of the surface of the unpolished photoreceptor is less than 0.006 μm in each of the axial direction and the circumferential direction, indicating that the surface is a nearly mirror surface with extremely small surface roughness.

In Example 1, the calculated average roughness (Ra) of the photoreceptor drum in the circumferential direction is equivalent to that of the unpolished photoreceptor 3, namely, less than 0.006 μm, whereas the calculated average roughness (Ra) of the photoreceptor drum in the axial direction is more than 0.01 μm, namely, 0.0106 μm, indicating that the surface of the photoreceptor drum is roughened in the axial direction.

In Example 2, the calculated average roughness (Ra) of the photoreceptor drum in the circumferential direction is equivalent to that of the unpolished photoreceptor 3, namely, less than 0.006 μm, whereas the calculated average roughness (Ra) of the photoreceptor drum in the axial direction is more than 0.01 μm, namely, 0.0124 μm, indicating that the surface of the photoreceptor drum is roughened in the axial direction.

In Example 3, the calculated average roughness (Ra) of the photoreceptor drum in the circumferential direction is equivalent to that of the unpolished photoreceptor, namely, less than 0.006 μm, whereas the calculated average roughness (Ra) of the photoreceptor drum in the axial direction is less than but close to 0.01 μm, namely, 0.0077 μm, indicating that the surface of the photoreceptor drum is roughened in the axial direction.

In Example 4, the calculated average roughness (Ra) of the photoreceptor drum in the circumferential direction is equivalent to that of the unpolished photoreceptor, namely, less than 0.006 μm, whereas the calculated average roughness (Ra) of the photoreceptor drum in the axial direction is less than 0.01 μm, namely, 0.0053 μm, indicating that the surface of the photoreceptor drum is roughened in the axial direction, but to a lesser extent.

FIGS. 14 to 16 show the measurement results of the surface roughness of the photoreceptor drums after formation of images on 3,000 sheets.

As shown in FIGS. 14 to 16, both of the calculated average roughness (Ra) of the surface of the unpolished photoreceptor drum in the axial direction and the calculated average roughness (Ra) of the surface of the unpolished photoreceptor drum in the circumferential direction are higher than those of the initial condition, namely, 0.0082 μm and 0.0052 μm, respectively, indicating that the edge of the cleaning blade gradually polishes and roughens the surface of the photoreceptor drum as it scrapes off residual toner after transfer in an image-forming process.

Surface Appearance

Figure 17:
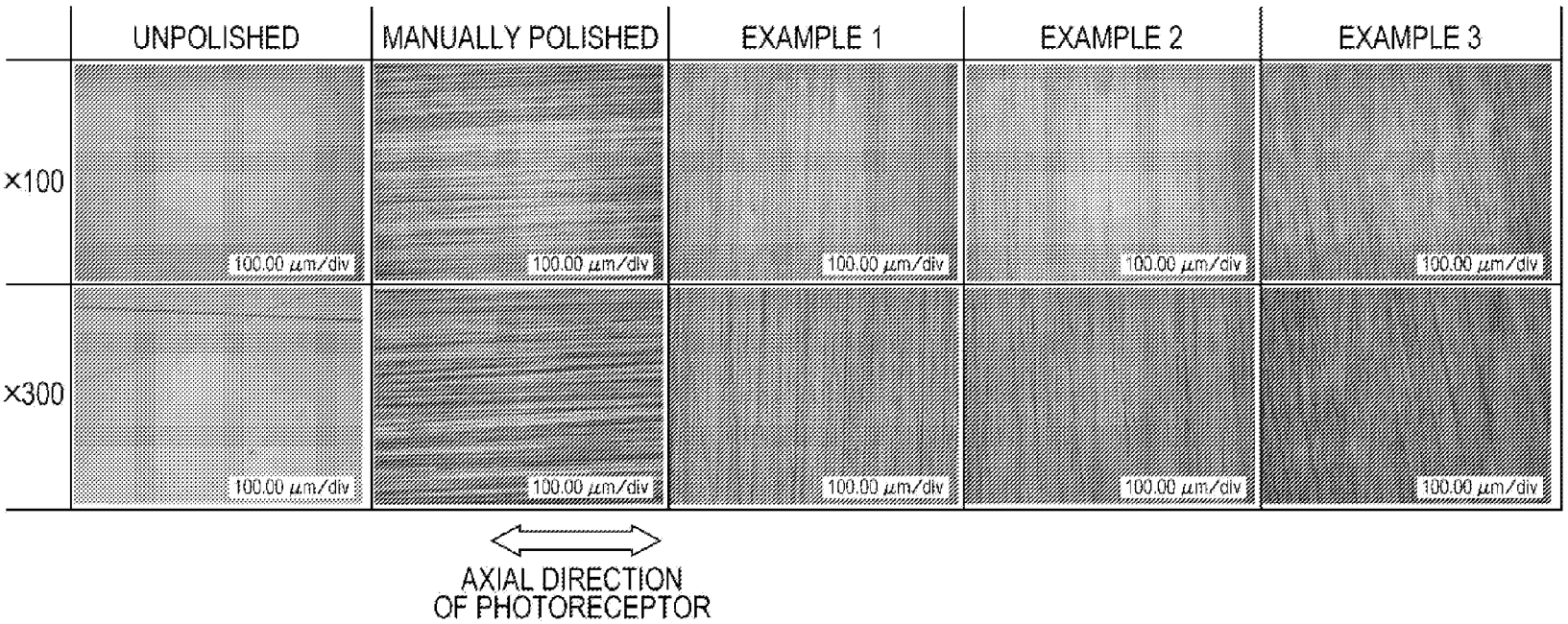
FIG. 17 is a set of micrographs showing the surfaces of the photoreceptors produced by the method for producing a photoreceptor according to the first exemplary embodiment of the invention.

FIG. 17 shows optical micrographs of the surfaces of the photoreceptor drums visually observed at magnifications of 100 and 300 times immediately after polishing.

In Example 1, as shown in FIG. 17, lines due to polishing are formed as fine streaks inclined in one direction with respect to the rotational direction of the photoreceptor drum. In Example 2, lines due to polishing are formed as fine streaks inclined in crossing directions with respect to the rotational direction of the photoreceptor drum. In Example 3, lines due to polishing are formed as fine streaks inclined in crossing directions with respect to the rotational direction of the photoreceptor drum, and the angle of inclination of the fine streaks is larger than that of Example 2.

Drive Torque of Photoreceptor Drum

Figure 18:
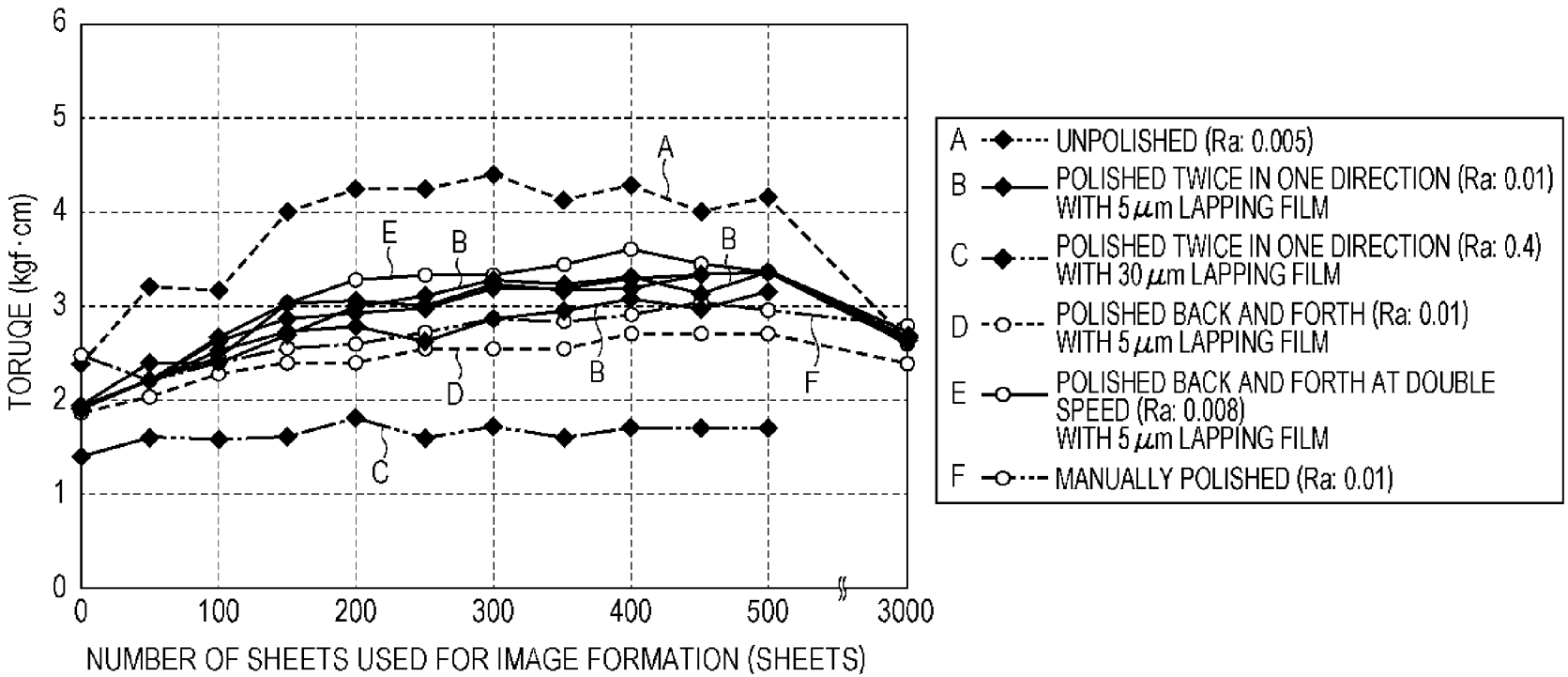
FIG. 18 is a graph showing the drive torque of photoreceptor drums produced using photoreceptors produced by the method for producing a photoreceptor according to the first exemplary embodiment of the invention.

FIG. 18 shows the measurement results of the drive torque of photoreceptor drums obtained from the current through a drive motor that drives the photoreceptor drums. The image-forming apparatus used is a benchmark model in which the cleaning blade 8 abuts the surface of the photoreceptor drum under the actual use conditions for the image-forming apparatus.

As shown in FIG. 18, the initial drive torque of the unpolished photoreceptor drum is about 2.5 kgf·cm. The drive torque then increases to and remains at values exceeding 4.0 kgf·cm. After formation of images on 3,000 sheets, the drive torque decreases to about 2.6 kgf·cm, although the values during the process are not shown.

For the polished photoreceptor drums, the initial drive torque is low, namely, about 1.5 to 2.5 kgf·cm. The drive torque then remains within the range of about 1.5 to 3.5 kgf·cm and decreases to about 2.5 to 2.8 kgf·cm after formation of images on 3,000 sheets.

As shown in FIG. 18, the use of a lapping film having a grain size of 30 μm as the polishing sheet 210 is desirable in terms of drive torque because the drive torque is remarkably low, namely, about 1.5 to 1.8 kgf·cm.

However, if a lapping film having a grain size as large as 30 μm is used as the polishing sheet 210, the edge of the cleaning blade 8 may be damaged by large ridges and grooves formed on the surface of the photoreceptor drum 3 by polishing.

Although no defective cleaning due to damage to the cleaning blade 8 occurs in any of the series of experiments conducted by the inventors, the polishing sheet 210 for polishing the surface of the photoreceptor 100 may be selected taking into account possible damage to the cleaning blade 8.

According to the above exemplary embodiment, defective cleaning tends not to occur because, as described above, the edge of the cleaning blade 8 is substantially uniformly worn.

Contamination of Charging Roller

In addition, the inventors conduct an experiment in which the surface of the charging roller is visually checked for contamination.

As a result, for the unpolished photoreceptor drum, a white residue of toner additive is found on the surface of the charging roller substantially over the entire length after formation of images on 3,000 sheets.

In Examples 1 and 2, on the other hand, the surface of the charging roller is hardly contaminated after formation of images on 3,000 sheets.

Electrical Properties and Image Quality

In addition, the inventors conduct an experiment in which the photoreceptor drums are examined for electrical properties and image quality. As a result, the electrical properties and the image quality are good for both of the unpolished and polished photoreceptor drums.

Although a tandem image-forming apparatus including multiple image-forming sections has been described as an example of an image-forming apparatus including a photoreceptor in the above exemplary embodiment, the type of image-forming apparatus used is not limited thereto; for example, it may be a four-cycle image-forming apparatus including a single photoreceptor in which images of different colors are sequentially formed on the surface of the photoreceptor and are transferred onto an intermediate transfer body or a recording medium, or may be a monochrome image-forming apparatus including a single photoreceptor.

As used herein, the term "photoreceptor" refers to both a photoreceptor having a polished surface and a photoreceptor having an unpolished surface; photoreceptors according to exemplary embodiments of the invention finally have a polished surface.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A method for producing a photoreceptor, comprising:

forming at least a photosensitive layer as a coating layer on a surface of a substantially cylindrical photoreceptor; and polishing a surface of the coating layer formed on the photoreceptor in the layer formation by rotating the photoreceptor and moving a polishing member in a direction crossing a circumferential direction of the photoreceptor in contact with the surface of the coating layer on the photoreceptor, wherein a ratio of a movement speed of the polishing member in the direction crossing the circumferential direction of the photoreceptor to a rotating speed of the photoreceptor is about 1:5 to 1:50.

2. The method for producing a photoreceptor according to claim 1, wherein the surface of the coating layer on the photoreceptor is polished multiple times in the polishing by moving the polishing member from one end to another end of the photoreceptor multiple times.

3. The method for producing a photoreceptor according to claim 1, wherein the surface of the coating layer on the photoreceptor is polished multiple times in the polishing by moving the polishing member back and forth in the direction crossing the circumferential direction of the photoreceptor at least once.

4. A process cartridge comprising a photoreceptor produced by the method according to claim 1, wherein the process cartridge is attachable to and detachable from an image-forming apparatus.

5. An image-forming apparatus comprising:

a photoreceptor produced by the method according to claim 1;

a developing unit that develops an electrostatic latent image formed on the photoreceptor;

a transfer unit that transfers a toner image formed on the photoreceptor onto a recording medium; and a fixing unit that fixes the toner image transferred onto the recording medium.

* * * * *